US005211840A

United States Patent [19]

Lehrer et al.

[11] Patent Number: 5,211,840

[45] Date of Patent: May 18, 1993

[54] NEUTRALIZING AMINES WITH LOW SALT PRECIPITATION POTENTIAL

[75] Inventors: Scott E. Lehrer, Houston; James G. Edmondson, Conroe, both of Tex.

[73] Assignee: Betz Laboratories, Inc., Trevose, Pa.

[21] Appl. No.: 697,136

[22] Filed: May 8, 1991

[51] Int. Cl.[5] ..... C10G 7/10

[52] U.S. Cl. ..... 208/348; 208/48 AA; 208/47; 423/228; 423/240 S; 203/7

[58] Field of Search ..... 208/48 AA, 348; 423/228, 240; 203/7

[56] References Cited

U.S. PATENT DOCUMENTS

| | | | |
|---|---|---|---|
| 2,972,577 | 2/1961 | Selbin | 208/348 |
| 3,132,577 | 5/1964 | Backlund | 208/348 |
| 3,472,666 | 10/1969 | Foroulis | 106/14 |
| 3,779,905 | 12/1973 | Stedman | 208/348 |
| 3,981,780 | 9/1976 | Scherrer et al. | 203/7 |
| 4,062,764 | 12/1977 | White et al. | 208/348 |
| 4,229,284 | 10/1980 | White et al. | 208/348 |
| 4,430,196 | 2/1984 | Niu | 208/47 |
| 4,511,453 | 4/1985 | Baumert et al. | 208/348 |
| 4,511,460 | 4/1985 | Baumert | 208/348 |
| 4,569,750 | 2/1986 | Brownawell | 208/348 |
| 4,596,655 | 6/1986 | Van Eijl | 208/348 |
| 4,806,229 | 2/1989 | Ferguson et al. | 208/47 |
| 4,952,301 | 8/1990 | Awbrey | 208/348 |

*Primary Examiner*—Helane Myers

*Attorney, Agent, or Firm*—Alexander D. Ricci; Gregory M. Hill

[57] ABSTRACT

A process for adding an amine having a pKa of between 5 and 8 to a petroleum refinery distillation unit for the purpose of neutralizing acidic species contained in the hydrocarbon feedstock. The use of these amines raises the dew point pH sufficiently to prevent corrosion of the metallic surfaces of the overhead equipment while reducing the potential for the precipitation of amine salts.

4 Claims, 3 Drawing Sheets

NEUTRALIZING AMINES WITH LOW SALT PRECIPITATION POTENTIAL

FIELD OF THE INVENTION

The present invention relates to the refinery processing of crude oil. Specifically, it is directed toward the problem of corrosion of refinery equipment caused by corrosive elements found in the crude oil.

BACKGROUND

Hydrocarbon feedstocks such as petroleum crudes, gas oil, etc. are subjected to various processes in order to isolate and separate different fractions of the feedstock. In refinery processes, the feedstock is distilled so as to provide light hydrocarbons, gasoline, naphtha, kerosene, gas oil, etc.

The lower boiling fractions are recovered as an overhead fraction from the distillation zones. The intermediate components are recovered as side cuts from the distillation zones. The fractions are cooled, condensed, and sent to collecting equipment. No matter what type of petroleum feedstock is used as the charge, the distillation equipment is subjected to the corrosive activity of acids such as $H_2S$, HCl, organic acids and $H_2CO_3$.

Corrosive attack on the metals normally used in the low temperature sections of a refinery process system, i.e. (where water is present below its dew point) is an electrochemical reaction generally in the form of acid attack on active metals in accordance with the following equations:

(1) at the anode $$Fe \rightleftharpoons Fe^{++} + 2(e)$$

(2) at the cathode $$2H^{+} + 2(e) \rightleftharpoons 2H$$

$$2H \rightleftharpoons H_2$$

The aqueous phase may be water entrained in the hydrocarbons being processed and/or water added to the process for such purposes as steam stripping. Acidity of the condensed water is due to dissolved acids in the condensate, principally HCl, organic acids and $H_2S$ and sometimes $H_2CO_3$. HCl, the most troublesome corrosive material, is formed by hydrolysis of calcium and magnesium chlorides originally present in the brines.

Corrosion may occur on the metal surfaces of fractionating towers such as crude towers, trays within the towers, heat exchangers, etc. The most troublesome locations for corrosion are tower top trays, overhead lines, condensers, and top pump around exchangers. It is usually within these areas that water condensation is formed or carried along with the process stream. The top temperature of the fractionating column is usually, but not always, maintained about at or above the boiling point of water. The aqueous condensate formed contains a significant concentration of the acidic components above-mentioned. This high concentration of acidic components renders the pH of the condensate highly acidic and, of course, dangerously corrosive. Accordingly, neutralizing treatments have been used to render the pH of the condensate more alkaline to thereby minimize acid-based corrosive attack at those apparatus regions with which this condensate is in contact.

One of the chief points of difficulty with respect to corrosion occurs above and in the temperature range of the initial condensation of water. The term "initial condensate" as it is used herein signifies a phase formed when the temperature of the surrounding environment reaches the dew point of water. At this point a mixture of liquid water, hydrocarbon, and vapor may be present. Such initial condensate may occur within the distilling unit itself or in subsequent condensors. The top temperature of the fractionating column is normally maintained above the dew point of water. The initial aqueous condensate formed contains a high percentage of HCl. Due to the high concentration of acids dissolved in the water, the pH of the first condensate is quite low. For this reason, the water is highly corrosive. It is important, therefore, that the first condensate be rendered less corrosive.

In the past, highly basic ammonia has been added at various points in the distillation circuit in an attempt to control the corrosiveness of condensed acidic materials. Ammonia, however, has not proven to be effective with respect to eliminating corrosion occurring at the initial condensate. It is believed that ammonia has been ineffective for this purpose because it does not condense completely enough to neutralize the acidic components of the first condensate.

At the present time, amines such as morpholine and methoxypropylamine (U.S. Pat. No. 4,062,746) are used successfully to control or inhibit corrosion that ordinarily occurs at the point of initial condensation within or after the distillation unit. The addition of these amines to the petroleum fractionating system substantially raises the pH of the initial condensate rendering the material noncorrosive or substantially less corrosive than was previously possible. The inhibitor can be added to the system either in pure form or as an aqueous solution. A sufficient amount of inhibitor is added to raise the pH of the liquid at the point of initial condensation to above 4.5 and, preferably, to at least about 5.0.

Commercially, morpholine and methoxypropylamine have proven to be successful in treating many crude distillation units. In addition, other highly basic ($pKa > 8$) amines have been used, including ethylenediamine and monoethanolamine. Another commercial product that has been used in these applications is hexamethylenediamine.

A specific problem has developed in connection with the use of these highly basic amines for treating the initial condensate. This problem relates to the hydrochloride salts of these amines which tend to form deposits in distillation columns, column pumparounds, overhead lines and in overhead heat exchangers. These deposits manifest themselves after the particular amine has been used for a period of time. These deposits can cause both fouling and corrosion problems and are most problematic in units that do not use a water wash.

RELATED ART

Conventional neutralizing compounds include ammonia, morpholine and ethylenediamine. U.S. Pat. No. 4,062,764 discloses that alkoxylated amines are useful in neutralizing the initial condensate.

U.S. Pat. No. 3,472,666 suggests that alkoxy substituted aromatic amines in which the alkoxy group contains from 1 to 10 carbon atoms are effective corrosion inhibitors in petroleum refining operations. Representative examples of these materials are aniline, anisidine and phenetidines.

Alkoxylated amines, such as methoxypropylamine, are disclosed in U.S. Pat. No. 4,806,229. They may be used either alone or with the film forming amines of previously noted U.S. Pat. No. 3,472,666.

The utility of hydroxylated amines is disclosed in U.S. Pat. No. 4,430,196. Representative examples of these neutralizing amines are dimethylisopropanolamine and dimethylaminoethanol.

U.S. Pat. No. 3,981,780 suggests that a mixture of the salt of a dicarboxylic acid and cyclic amines are useful corrosion inhibitors when used in conjunction with traditional neutralizing agents, such as ammonia.

Many problems are associated with traditional treatment programs. Foremost is the inability of some neutralizing amines to condense at the dew point of water thereby resulting in a highly corrosive initial condensate. Of equal concern is the formation on metallic surfaces of hydrochloride or sulfide salts of those neutralizing amines which will condense at the water dew point. The salts appear before the dew point of water is reached and result in fouling and underdeposit corrosion, often referred to as "dry" corrosion.

Accordingly, there is a need in the art for a neutralizing agent which can effectively neutralize the acidic species at the point of the initial condensation without causing the formation of fouling salts with their corresponding "dry" corrosion.

GENERAL DESCRIPTION OF THE INVENTION

The above and other problems are addressed by the present invention. It has been discovered that certain amines may be chosen for their ability to neutralize corrosion causing acidic species at the dew point of water which will not form salt precipitates prior to reaching the dew point temperature. By selecting amines having pKa between 5 and 8 and which form salts that have a high equilibrium vapor pressure, a neutralizing treatment program achieving the above objectives has been discovered.

Figure 1:
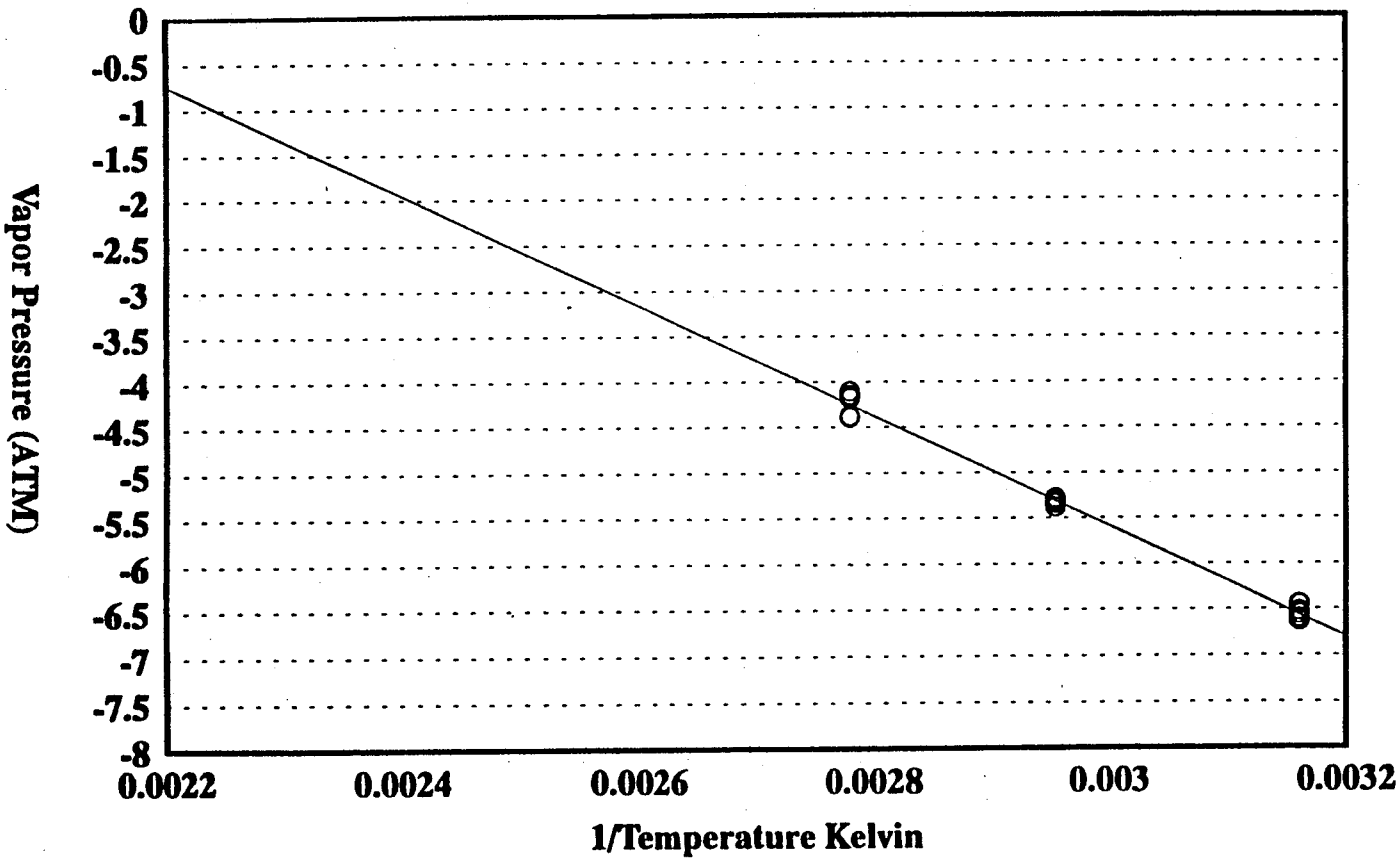
FIG. 1 shows vapor pressure as a function of temperature.
Figure 2:
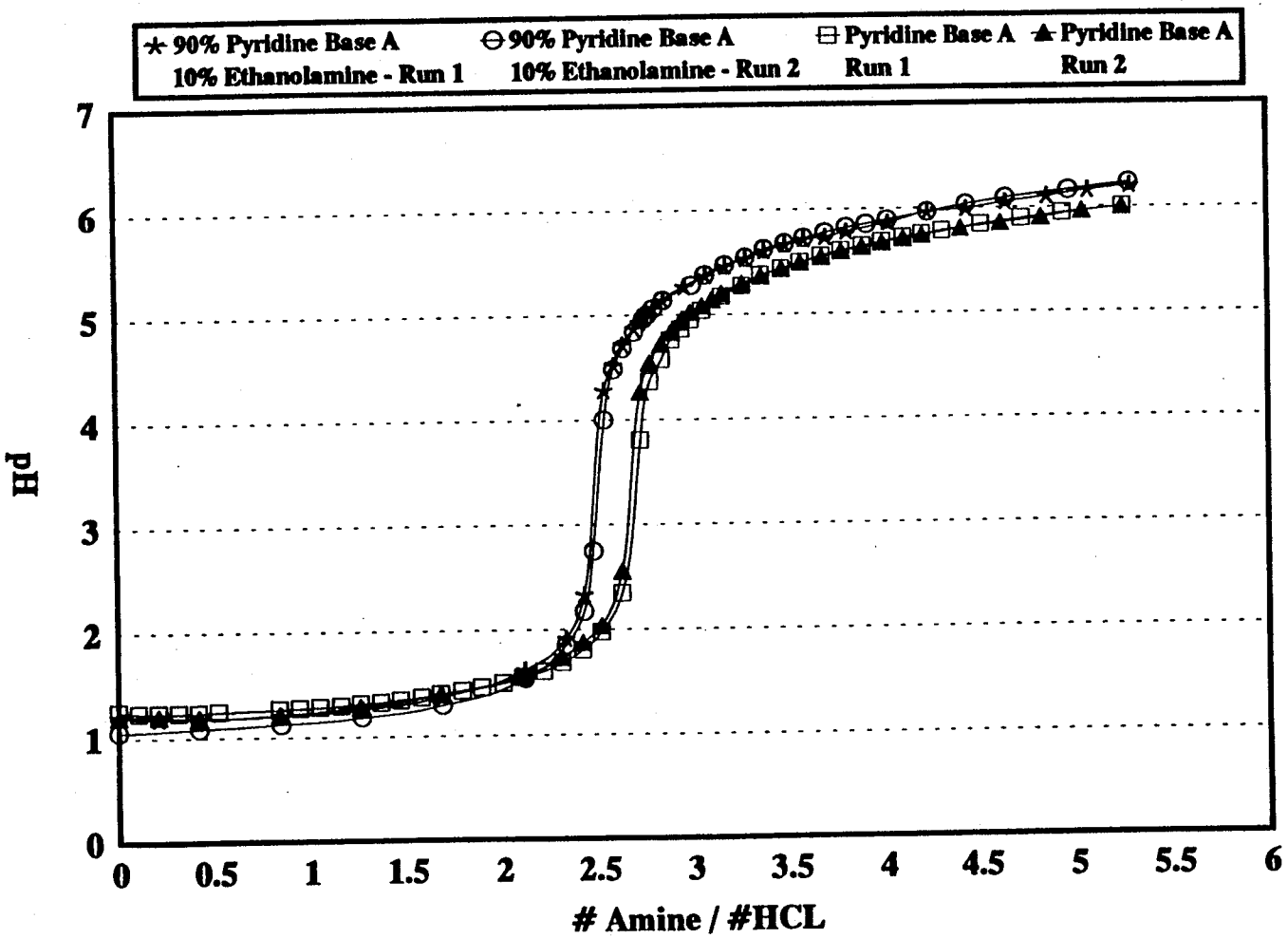
Figure 3:
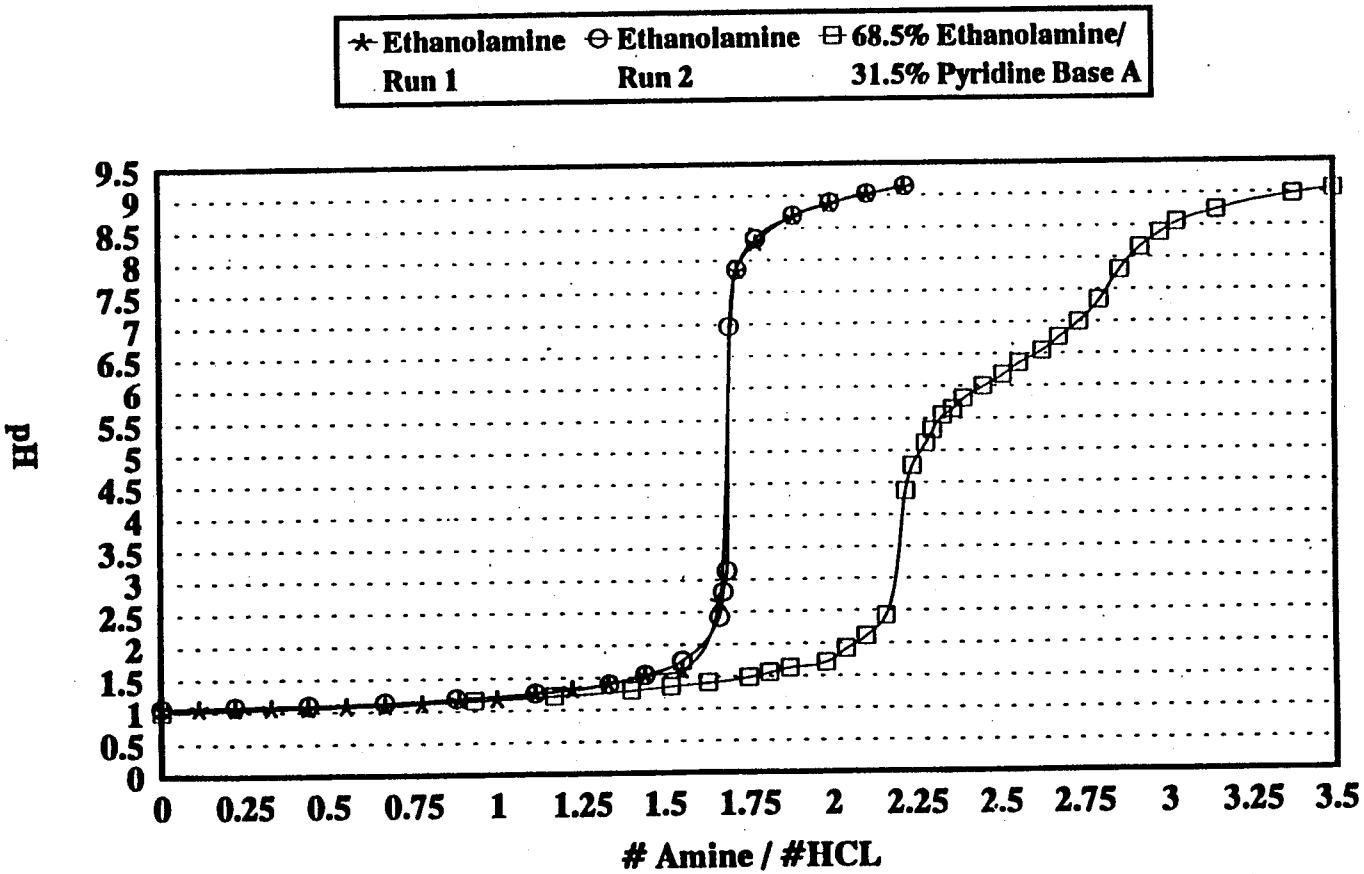

FIG. II shows the affect of blending low and high pKa amines on HCl neutralization.

FIG. III shows the buffering effect of low pKa amines.

DETAILED DESCRIPTION OF THE INVENTION

The proper selection of a neutralizing agent for petroleum refining operations according to the present invention requires that the agent effectively neutralize the acidic corrosion causing species at the initial condensation or dew point of the water. Additionally, the agent should not form salts with those acidic species above the water dew point which, in turn, then deposit on the metallic surfaces of the overhead equipment resulting in fouling and/or underdeposit or "dry" corrosion. The deposition of these salts is due to the presence of sufficient hydrochloric acid and amine so that the amine salt vapor pressure is exceeded at temperatures above the water dew point. The advantage of using low pKa amines in place of traditional (highly basic) amines is that they form hydrochloride salts that do not exceed their vapor pressure until after the water dew point is reached. Once the dew point is achieved, free water is present to wash away the amine hydrochloride salts that may subsequently form.

It has been discovered that by selecting less basic amines having a pKa of from 5 to 8, the above noted objectives are met. This is an unexpected departure from conventional teaching and practice in which strongly basic amines are used. It is thought by other practitioners that the stronger the base the better because the very acidic pH of the initial condensate requires the need for a strong base to raise the pH to less corrosive levels, such as to 4.0 and above.

The following is a list of characteristic amines shown with their corresponding pKa values. These amines are exemplary of the neutralizing agents contemplated by the present invention. This list is not intended to limit the scope of useful compounds to only those shown.

| Amine | pKa |
|---|---|
| pyridine | 5.25 |
| 2-amino pyridine | 6.82 |
| 2-benzyl pyridine | 5.13 |
| 2,5 diamino pyridine | 6.48 |
| 2,3 dimethyl pyridine | 6.57 |
| 2,4 dimethyl pyridine | 6.99 |
| 3,5 dimethyl pyridine | 6.15 |
| methoxypyridine | 6.47 |
| isoquinoline | 5.42 |
| 1-amino isoquinoline | 7.59 |
| N,N diethylaniline | 6.61 |
| N,N dimethylaniline | 5.15 |
| 2-methylquinoline | 5.83 |
| 4-methylquinoline | 5.67 |
| ethylmorpholine | 7.60 |
| methylmorpholine | 7.14 |
| 2-picoline | 5.90 |
| 3-picoline | 5.68 |
| 4-picoline | 6.02 |

The selection of less basic amines useful as effective neutralizers is augmented by an analysis of the tendency of a selected amine to form a salt precipitate with the acidic species. Neutralizing amines having a low precipitation potential are desired and are determined by analyzing the equilibrium vapor pressures of the corresponding amine salt. Knudsen sublimation pressure testing was conducted on numerous amine chloride salts to measure their equilibrium vapor pressures at various temperatures. This testing procedure is described in detail in experimental Physical Chemistry, Farrington, et al, McGraw Hill, 1970, pp 53–55. The procedure defined therein is hereby incorporated by reference.

FIG. I shows the vapor pressures of 4-picoline HCl plotted as a function of temperature and was constructed from data collected by the Knudsen sublimation technique. These data are plotted the log of vapor pressure (in atmospheres) vs. 1/T°K in order to generate a linear plot. Such plots were drawn and linear equations determined for each material tested.

Table I shows the vapor pressures of various amine hydrochloride salts at temperature intervals of 10° F. between 200° F. and 350° F. These values are calculated from the above derived equations. It is evident that as temperature rises, the equilibrium vapor pressure of all salts tested increases. However over the broad temperature range shown in Table I, the picoline and pyridine hydrochloride salts exhibit vapor pressures which are 100 to 1,000 those of $NH_4Cl$ or morpholine hydrochloride.

TABLE I

| F° Temp | $NH_4Cl$ | 4-Picoline HCl | Pyridine HCl | Methylmorpholine HCl | Morpholine HCl |
|---|---|---|---|---|---|
| | Vapor Pressure (ATM) vs Temperature of Amine Hydrochloride Salts | | | | |
| 200 | $1.0 \times 10^{-6}$ | $1.13 \times 10^{-4}$ | $1.88 \times 10^{-4}$ | $3.16 \times 10^{-6}$ | $9.5 \times 10^{-7}$ |
| 210 | $2.0 \times 10^{-6}$ | $1.99 \times 10^{-4}$ | $2.92 \times 10^{-4}$ | $5.45 \times 10^{-6}$ | $1.0 \times 10^{-6}$ |
| 220 | $3.0 \times 10^{-6}$ | $3.45 \times 10^{-4}$ | $4.50 \times 10^{-4}$ | $9.26 \times 10^{-6}$ | $2.0 \times 10^{-6}$ |
| 230 | $5.0 \times 10^{-6}$ | $5.90 \times 10^{-4}$ | $6.83 \times 10^{-4}$ | $1.55 \times 10^{-5}$ | $2.0 \times 10^{-6}$ |
| 240 | $7.0 \times 10^{-6}$ | $9.94 \times 10^{-4}$ | $1.03 \times 10^{-3}$ | $2.55 \times 10^{-5}$ | $3.0 \times 10^{-6}$ |
| 250 | $1.0 \times 10^{-5}$ | $1.65 \times 10^{-3}$ | $1.52 \times 10^{-3}$ | $4.14 \times 10^{-5}$ | $4.0 \times 10^{-6}$ |
| 260 | $2.0 \times 10^{-5}$ | $2.70 \times 10^{-3}$ | $2.23 \times 10^{-3}$ | $6.64 \times 10^{-5}$ | $6.0 \times 10^{-6}$ |
| 270 | $2.0 \times 10^{-5}$ | $4.34 \times 10^{-3}$ | $3.24 \times 10^{-3}$ | $1.05 \times 10^{-4}$ | $7.0 \times 10^{-6}$ |
| 280 | $3.0 \times 10^{-5}$ | $6.92 \times 10^{-3}$ | $4.66 \times 10^{-3}$ | $1.64 \times 10^{-4}$ | $9.0 \times 10^{-6}$ |
| 290 | $5.0 \times 10^{-5}$ | $1.09 \times 10^{-2}$ | $6.64 \times 10^{-3}$ | $2.53 \times 10^{-4}$ | $1.2 \times 10^{-5}$ |
| 300 | $7.0 \times 10^{-5}$ | $1.69 \times 10^{-2}$ | $9.36 \times 10^{-3}$ | $3.86 \times 10^{-4}$ | $1.5 \times 10^{-5}$ |
| 310 | $9.0 \times 10^{-5}$ | $2.60 \times 10^{-2}$ | $1.30 \times 10^{-2}$ | $5.83 \times 10^{-4}$ | $2.0 \times 10^{-5}$ |
| 320 | $1.0 \times 10^{-4}$ | $3.96 \times 10^{-2}$ | $1.81 \times 10^{-2}$ | $8.71 \times 10^{-4}$ | $2.5 \times 10^{-5}$ |
| 330 | $2.0 \times 10^{-4}$ | $5.95 \times 10^{-2}$ | $2.49 \times 10^{-2}$ | $1.29 \times 10^{-3}$ | $3.1 \times 10^{-5}$ |
| 340 | $2.0 \times 10^{-4}$ | $8.86 \times 10^{-2}$ | $3.40 \times 10^{-2}$ | $1.89 \times 10^{-3}$ | $3.9 \times 10^{-5}$ |
| 350 | $3.0 \times 10^{-4}$ | $1.31 \times 10^{-1}$ | $4.60 \times 10^{-2}$ | $2.73 \times 10^{-3}$ | $4.8 \times 10^{-5}$ |

It is well known that when the conventional neutralizer ammonia is used, the resulting ammonium salts can precipitate before the initial condensation temperature is reached. The point at which they precipitate is a function of the equilibrium vapor pressure of the salt. By comparing the vapor pressures of various amine salts at selected temperatures with the vapor pressure of the ammonium salt, a precipitation potential for each amine salt is determined based on the precipitation potential of the ammonium salt. Table II shows the precipitation potential of certain select amine salts. It is quite evident that those amine salts having the lowest precipitation potential (below the ammonium salt) are those formed from amines having a pKa of between 5 and 8.

TABLE II

| Amine Chloride Salt | pKa | V.P. (ATM) @ 300° F. (95% Confidence Interval) | V.P. (ATM) @ 225° F. (95% Confidence Interval) | Precipitation Potential* |
|---|---|---|---|---|
| | | Amine Salt Precipitation Potential | | |
| Ethylenediamine HCl | 10.7 | $1.6–4.6 \times 10^{-7}$ | $1.9–5.6 \times 10^{-8}$ | 140.0 |
| Ethanolamine HCl | 9.50 | $2.5–4.5 \times 10^{-6}$ | $2.9–5.3 \times 10^{-7}$ | 13.0 |
| Morpholine HCl | 8.33 | $1.2–1.9 \times 10^{-5}$ | $1.6–2.6 \times 10^{-6}$ | 2.5 |
| $NH_3.HCl$ | 9.35 | $5.5–8.0 \times 10^{-5}$ | $3.1–4.4 \times 10^{-6}$ | 1.0 |
| Methylmorpholine HCl | 7.14 | $3.2–4.8 \times 10^{-4}$ | $1.0–1.5 \times 10^{-5}$ | 0.20 |
| Ethylmorpholine HCl | 7.60 | $3.0–4.2 \times 10^{-4}$ | $1.1–1.6 \times 10^{-5}$ | 0.24 |
| Pyridine Base A** HCl | 6.0 | $1.2–1.9 \times 10^{-3}$ | $1.1–1.7–10^{-4}$ | 0.035 |
| Pyridine HCl | 5.25 | $0.9–1.0 \times 10^{-2}$ | $5.1–6.1 \times 10^{-4}$ | .007 |
| 4-Picoline HCl | 6.02 | $1.5–2.0 \times 10^{-2}$ | $3.9–5.3 \times 10^{-4}$ | .005 |
| 3-Picoline HCl | 5.68 | $6.4–8.1 \times 10^{-2}$ | $1.3–1.7 \times 10^{-3}$ | .0014 |

*Precipitation Potential = Average V.P. $NH_4Cl$/Average V.P. amine salt over the temperature range of 225°–300° F.

**Pyridine Base A = 2-picoline, 3-picoline, 4-picoline and pyridine

The neutralizing amines according to the present invention are effective at inhibiting the corrosion of the metallic surfaces of petroleum fractionating systems such as crude towers, trays within such towers, heat exchangers, receiving tanks, pumparounds, overhead lines, reflux lines, connecting pipes and the like. These amines may be added to the distillation unit at any of these points, the tower charge or at any other location in the overhead equipment system prior to the location where the condensate forms.

It is necessary to add a sufficient amount of the neutralizing amine compound to neutralize the acidic corrosion causing species. It is desirable that the neutralizing amine be capable of raising the pH of the initial condensate to 4.0 or greater. The amount of neutralizing amine compound required to achieve this objective is an amount sufficient to maintain a concentration of between 0.1 and 1,000 ppm, based on the total overhead volume. The precise neutralizing amount will vary depending upon the concentration of chlorides or other corrosive species. The neutralizing amines of the present invention are particularly advantageous in systems where chloride concentrations are especially high, and where a water wash is absent.

The absence of a water wash causes a system to have a lower dew point temperature than would be present if a water wash is used. The presence of a high chloride concentration necessitates the addition of a sufficient neutralizing amine to neutralize the hydrochloric acid. These factors increase the likelihood of an amine hydrochloride salt exceeding the equilibrium vapor pressure and depositing before the water dew point is reached.

An alternate method of using the low pKa amines is to blend them with more basic neutralizing amines such as methoxypropylamine, ethanolamine, morpholine and methylisopropylamine. There are several advantages which result from these blends, depending upon the parameters of the system to be treated, over using either class of amines alone.

One advantage is found in blending a minor amount of highly basic amine with a low pKa amine. These blends would be advantageous to use in systems where a subneutralizing quantity of highly basic amine can be used without causing above the water dew point corrosion and/or fouling problems. FIG. II demonstrates the benefit in neutralizing strength realized by blending a small amount of a highly basic amine with a low pKa neutralizing amine. Using a blend of mostly low pKa neutralizing amine reduces the amine salt deposition potential versus applying a neutralizing quantity of the highly basic amine.

A second benefit of blending low pKa neutralizing amines with highly basic neutralizing amines results from the buffering ability of the low pKa neutralizing amines. A highly basic amine such as methoxypropylamine or ethanolamine is not buffered in the desired pH control range. This is demonstrated in FIG. III. Using a traditional neutralizing amine in a system that is not naturally buffered, it is difficult to control pH at the commonly desired pH control range of 5–7. Adding a low pKa amine as a minor component gives considerable buffering in this pH range.

FIELD TRIAL

Neutralizing amines having a pKa of between 5 and 8 were evaluated at an Oklahoma refinery for the purpose of determining their efficacy at raising dew point pH. A neutralizing amine according to the present invention consisting of a blend of 85% 4-picoline and 15% 3-picoline was tested and compared with a conventional neutralizing amine, Betz 4H4 (a blend of highly basic amines), available from Betz Laboratories.

Conditions in the fractionator unit were as follows. The bottoms temperature was 668° F.±1°. Tower top pressure and temperature remained constant at 10.5 psig and 257±1°. Tower top pressure and temperature remained constant at 10.5 psig and 257±1° F., respectively. Total overhead flow varied little on a daily basis and averaged 10,850 barrels per day (BPD).

Water samples were collected using a Condensate On Line Analyzer (COLA) and from the system accumulator. The COLA is a device that hooks up to an overhead vapor line and passes these vapors through a vessel that collects condensed naphtha and/or water. Cooling water can be applied to the COLA to cool the vapors further and increase condensation. The COLA was used without the presence of cooling water in order to obtain samples as close to the dew point of water as possible. The temperature in the COLA was measured to be between 200° F. and 207° F.

The neutralizer was fed continuously into the overhead prior to the overhead condensing system. The feed rate was varied and is shown in Table III and IV, below. It is indicated in gallons per day and is within the previously noted concentration range of 0.1 to 1,000 ppm. When the low pKa amine was blended with a minor amount (less than 20% of treatment) of the highly basic amine, excellent dew point pH elevation was achieved.

TABLE III

Comparison Between Betz 4H4 and a blended Picoline (70% aqueous solution of 4-Picoline, 15% 3-Picoline) on pH

| Neutralizer | Feed Rate (GPD) | Dew Point pH | Accumulator pH |
|---|---|---|---|
| None | — | 4.8 | 4.5 |

TABLE III-continued

Comparison Between Betz 4H4 and a blended Picoline (70% aqueous solution of 4-Picoline, 15% 3-Picoline) on pH

| Neutralizer | Feed Rate (GPD) | Dew Point pH | Accumulator pH |
|---|---|---|---|
| 4H4 | 2.0 | 8.3 | 5.3 |
| 4H4 | 4.1 | 8.7 | 5.6 |
| 4H4 | 9.0 | 9.8 | 6.3 |
| Blended Picoline | 6.2 | 5.2 | 5.3 |
| Blended Picoline | 12.5 | 5.3 | 5.4 |
| Blended Picoline | 18.4 | 6.6 | 5.4 |
| Blended Picoline | 30 | 6.0 | 5.6 |

TABLE IV

Mixed 4H4 and Blended Picoline (as in TABLE III)

| Feed Rate (GPD) 4H4 | Feed Rate (GPD) Blended Picoline | % Active 4H4/ % Active Blended Picoline | Dew Point pH | Accumulator pH |
|---|---|---|---|---|
| 1.1 | 6.0 | 8%/92% | 7.8 | 5.6 |
| 2.1 | 10.9 | 8%/92% | 8.9 ± 1 | 5.7 ± .1 |
| 1.0 | 1.8 | 20%/80% | 7.0 | 5.2 |
| 2.0 | 3.5 | 20%/80% | 8.7 | 5.6 |

The desired pH elevation at the point of initial condensation was achieved with the picoline alone. However, a much higher pH results when the low pKa amines are blended with a minor amount of a highly basic neutralizer. The blends may be utilized very effectively in distillation systems where chloride upsets occur regularly or no water wash is employed. Additionally, these formulations may be useful in treating crude feedstocks which contain high amounts of acidic species.

We claim:

1. In a petroleum refining operation having at least one distillation unit for processing of hydrocarbon that contains chlorides at elevated temperatures, a method for preventing fouling caused by amine chloride salt deposits on the metallic surfaces of the overhead equipment in the distillation unit comprising adding to the distillation unit between 0.1 and 1000 ppm, based on overhead volume, of at least one neutralizing amine having a pKa of from 5 to 8 which permit the formation of amine chloride salts after the water dew point is reached.

2. The method of claim 1 wherein the neutralizing amine is added to the hydrocarbon at the tower charge, pumparounds, reflux lines, heat exchangers, receiving tanks, overhead lines and connecting pipes.

3. In a petroleum refining operation having at least one distillation unit for the processing of hydrocarbon that contains chlorides at elevated temperatures, a method for preventing fouling caused by amine chloride salt deposits on the metallic surfaces of the overhead equipment in the distillation unit comprising adding to the distillation unit between 0.1 and 1000 ppm, based on overhead volume, of at least one neutralizing amine having a pKa of from 5 to 8 and a more basic amine which permit the formation of amine chloride salts after the water dew point is reached.

4. The method of claim 3 wherein the neutralizing amine is added to the distillation unit at the tower charge, pumparounds, reflux lines, heat exchangers, receiving tanks, overhead lines and connecting pipes.

* * * * *